US012612199B2

(12) United States Patent
McMorris

(10) Patent No.: US 12,612,199 B2
(45) Date of Patent: Apr. 28, 2026

(54) PROCESS FOR PREPARING A PRE-MIXED ALCOHOLIC BEVERAGE

(71) Applicant: Ralph E. McMorris, Galveston, TX (US)

(72) Inventor: Ralph E. McMorris, Galveston, TX (US)

( * ) Notice: Subject to any disclaimer, the term of this patent is extended or adjusted under 35 U.S.C. 154(b) by 19 days.

(21) Appl. No.: 18/915,879

(22) Filed: Oct. 15, 2024

(65) Prior Publication Data

US 2025/0145316 A1 May 8, 2025

Related U.S. Application Data

(60) Provisional application No. 63/595,439, filed on Nov. 2, 2023.

(51) Int. Cl.

| | |
|---|---|
| ***B65B 3/04*** | (2006.01) |
| ***B65B 43/44*** | (2006.01) |
| ***B65B 43/50*** | (2006.01) |

(52) U.S. Cl.

CPC ..... *B65B 3/04* (2013.01); *B65B 43/44* (2013.01); *B65B 43/50* (2013.01)

(58) Field of Classification Search

CPC ..... B65B 3/04; B65B 43/44; B65B 43/50

See application file for complete search history.

(56) References Cited

U.S. PATENT DOCUMENTS

| | | | | |
|---|---|---|---|---|
| 4,646,626 | A | 3/1987 | Baecchi et al. | |
| 9,776,752 | B2 | 10/2017 | Franceschi et al. | |
| 10,138,007 | B2 | 11/2018 | Rubbi et al. | |
| 10,351,277 | B2 | 7/2019 | Trombetta et al. | |
| 10,472,105 | B2 | 11/2019 | Castellari et al. | |
| 2008/0156804 | A1 | 7/2008 | Bardou et al. | |
| 2008/0216666 | A1 | 9/2008 | Doglioni Majer | |
| 2013/0209618 | A1* | 8/2013 | Trombetta | B65D 85/808 428/35.8 |
| 2015/0158609 | A1 | 6/2015 | Villain et al. | |
| 2016/0198732 | A1* | 7/2016 | Charles | B65B 29/022 426/433 |
| 2016/0264348 | A1* | 9/2016 | Camera | B65D 85/8043 |
| 2017/0259989 | A1* | 9/2017 | Trombetta | B65B 7/164 |
| 2018/0178935 | A1* | 6/2018 | Baraccani | B65B 1/363 |
| 2019/0225357 | A1* | 7/2019 | Belbecir | B65B 29/06 |
| 2020/0262693 | A1* | 8/2020 | Stefanoni | B65D 85/8046 |
| 2021/0122511 | A1* | 4/2021 | Trombetta | B29C 65/02 |
| 2022/0234772 | A1* | 7/2022 | Footz | B65B 51/225 |
| 2022/0274725 | A1* | 9/2022 | Empl | B21D 22/28 |
| 2022/0317059 | A1* | 10/2022 | Balducci | B65B 43/46 |

(Continued)

OTHER PUBLICATIONS

"Cask & Kettle: Alcoholic Keurig K-Cup Coffee For Adults" by Dave Taylor on Go Fatherhood (https://gofatherhood.com/2020/10/cask-kettle-alcohol-keurig-kcup-coffee-for-adults/ ; published Oct. 10, 2020 (Year: 2020).*

*Primary Examiner* — Himchan Song

(74) *Attorney, Agent, or Firm* — Egbert, McDaniel & Swartz, PLLC

(57) ABSTRACT

A process for preparing a pre-mixed alcoholic beverage includes providing an empty beverage capsule, introducing a dry mix into the empty beverage capsule, adding a liquid alcohol into the dry mix-added beverage capsule so as to substantially filled beverage capsule, and affixing a lid over the substantially-filled beverage capsule. The empty beverage capsule is loaded onto a turntable.

12 Claims, 3 Drawing Sheets

(56) References Cited

U.S. PATENT DOCUMENTS

| | | | | |
|---|---|---|---|---|
| 2022/0348401 | A1 | 11/2022 | Frank et al. | |
| 2023/0084750 | A1* | 3/2023 | Brouwer | C12C 5/026 426/600 |
| 2023/0192419 | A1* | 6/2023 | Biondi | B65B 65/006 198/459.2 |
| 2023/0227192 | A1* | 7/2023 | Biondi | B65B 43/59 53/473 |
| 2023/0312150 | A1* | 10/2023 | Biondi | B65B 43/50 53/410 |
| 2023/0356869 | A1* | 11/2023 | Scrivani | B65B 47/06 |
| 2025/0026510 | A1* | 1/2025 | Lowe | B65B 7/2878 |

* cited by examiner

PROCESS FOR PREPARING A PRE-MIXED ALCOHOLIC BEVERAGE

CROSS-REFERENCE TO RELATED APPLICATIONS

The present application claims priority from U.S. Provisional Patent Application Ser. No. 63/595,439, filed on Nov. 2, 2023.

BACKGROUND OF THE INVENTION

The present invention relates to the preparation of alcoholic beverages. Particularly, the present invention relates to beverages produced from beverage capsules. More particularly, the present invention relates to a process for preparing a pre-mixed alcoholic beverage from a beverage capsule.

A single-serve beverage capsule has been typically used, in the past, for the brewing of coffee such that coffee is prepared only enough for a single portion. The single-serve coffee capsules can both reduce the time needed to brew coffee and simplify the brewing process by eliminating the need to measure out portions, flavorings and additives from large bulk containers. They can also help to keep the unused product pressurized by individually packaging portions separately without exposing the entire supply to air and light.

The beverage capsules typically are used in a non-removable receptacle on the brewing device. The capsules have an outer ring or rim that stays dry during use. This allows for removal and disposal after use without getting the user's hands wet or sticky. These capsules are can be sized for individual or multi-serving portions. These capsules, when used with automatic brewing, can help to provide consistency of product strength and flavor.

Currently, disposable beverage capsules for the preparation of the beverages are made from plastic materials. For example, U.S. Pat. No. 4,646,626 discloses a capsule from a plastic material provided with one or more holes, obtained on the lid, to allow the inflow of pressurized water during their use. The beverage exits the capsule through an opening in the bottom at an underlying collector. Because of the holes, in order to avoid the oxidation and deterioration of the organoleptic characteristics of the product, capsules are distributed in sealed packages.

In the past, these beverage capsules have been used for the dispensing of coffee and tea. Heretofore, these capsules have not been used for the dispensing of an alcoholic beverage. Typically, the interior of the capsules are filled with a coffee or tea powder material such that when hot water flows through the interior of the capsule, a finished coffee or tea product is released from the coffee machine.

Under many circumstances, users of the coffee machine would desire that a single portion alcoholic beverage be dispensed from the machine. As such, a need has developed so as to provide a pre-packaged beverage capsule that includes both alcohol and a dry mix for the alcoholic beverage such that when the alcohol and the dry mix pass through a coffee machine, the resulting hot product can be cooled and then consumed as a cold alcoholic drink or a hot alcoholic drink.

In the past, various patents have issued relating to techniques for filling and using such beverage capsules. For example, U.S. Pat. No. 9,776,752, issued Oct. 3, 2017 to Franceschi et al., teaches an apparatus and method for feeding empty capsules to a packaging machine. This discloses a feeding apparatus for feeding single empty capsules to a package machine and includes a magazine adapted to house a stack of trays that includes a plurality of empty capsules. A drawing and moving device is adapted to draw from the stack and move the tray. A separation device is adapted to receive the tray from the drawing and moving device and to obtain a single empty capsule. A transfer system is adapted to transfer the empty capsules from the separation device to a transport system of the packaging machine.

U.S. Pat. No. 10,138,007, issued on Nov. 27, 2018 to Rubbi et al., discloses a unit and method for filling containing elements. This unit has single-use capsules for extraction or infusion beverages and comprises a line for transport of containing elements designed to contain a dose of the product, a station for filling the containing elements comprising at least a first containing seat designed to receive a dose, a substation for forming a dose inside the first containing seat, and at least a second containing seat designed to receive the dose from the first containing seat. A substation transfers the dose from the first containing seat to the second containing seat. The device moves the first containing seat between the forming substation and the transfer substation and vice versa.

U.S. Pat. No. 10,351,277, issued on Jul. 16, 2019 to Trombetta et al., provides a process for making a capsule containing a dosing agent. The capsule includes a body defining an interior space and an opening. The capsule has ingredients and a dosing agent disposed in the interior space and a cover to seal the opening. The process and system includes depositing ingredients and the dosing agent in the interior space of the capsule and then covering the opening.

U.S. Pat. No. 10,472,105, issued on Nov. 12, 2019 to Castellari et al., provides a unit for feeding closing elements for closing containers of beverage capsules. This unit is a means for feeding a web of heat-sealable material along a predetermined path for feeding the web. A plurality of punches are positioned along the path for feeding the web of heat-sealable material in a region for forming the closing elements and are then movable between an operating position and a closing position.

U.S. Patent Application Publication No. 2017/0259989, published on Sep. 14, 2017 to Trombetta et al., teaches a beverage capsule for use in a beverage preparing machine. The beverage capsule includes a body defining an interior space having an opening. A filter is disposed in the body to define an ingredients chamber and an extraction chamber. The filter has an airflow permeability. Ingredients are disposed in the ingredients chamber and a cover is dispensed over the opening to seal the interior space. The filter includes a vent region between the top surface of the ingredients and the bottom surface for venting gas through the filter between the ingredients chamber and the extraction chamber.

U.S. Patent Application Publication No. 2008/0156804, published on Jul. 3, 2008 to Bardou et al., shows a system and method for packaging in a rigid container sealed by a flexible cover. A desired quantity of material to be packaged containing or together with some water or other liquid is placed in the container. The flexible cover is secured on the container so as to leave at least one unsealed opening. The container is heated and/or placed in a partial vacuum to bring the liquid above its boiling point to cause or permit vapor generated by the boiling liquid to expel other gases from the container through the unsealed opening. The container is sealed while gas or vapor is still flowing out of the container through the unsealed opening.

U.S. Patent Application Publication No. 2008/0216666, published on Sep. 11, 2008 to L. D. Majer, provides a capsule for the preparation of beverages within dispensing machines. This capsule has a sealing film which is perforated at the of time of use when the pressurized infusion water is supplied to the capsule and deforms the film so as to bring it in contact with underlying perforators fixed to the same capsule.

U.S. Patent Application Publication No. 2015/0158609, published on Jun. 11, 2015 to Villain et al., describes a method for packaging a beverage powder in a capsule. The capsule has a capsule body defining a cavity containing a quantity of beverage powder. The cavity is hermetically sealed. In particular, the quantity of the beverage powder is provided so as to evolve a gas within the cavity of the capsule body. A vacuum is applied into the cavity of the capsule body so that the internal pressure in the cavity is below atmospheric pressure. The capsule is sealed to hermetically close the cavity while maintaining the internal pressure in the cavity below the atmospheric pressure. The gas is retained within the cavity so that the internal pressure in the sealed-up capsule is above atmospheric pressure.

U.S. Patent Application Publication No. 2022/0348401, published on Nov. 3, 2022 to Frank et al., describes an aluminum formed coffee beverage capsule.

U.S. Patent Application Publication No. 2023/0084750, published a Mar. 16, 2023 to Brouwer et al., describes a single-serve capsule for preparing alcoholic beer. This single-serve capsule includes a first compartment and a second compartment. The first compartment comprises a liquid concentrate of an alcohol-free beer. The liquid beer concentrate has an ethanol content of 0-1% ABV. The second compartment comprises an alcoholic liquid containing between 12% and 100% ethanol and 0-88% water. The ethanol and the water together constitute 80 to 100% of the alcoholic liquid. The capsule is suitably used to prepare an alcoholic beer by mixing the contents of the capsule with carbonated water.

It is an object of the present invention to provide a process that prepares a pre-mixed alcoholic beverage.

It is another object of the present invention to provide a process wherein the pre-mixed alcoholic beverage can be easily dispensed through the use of a traditional single-served coffee maker.

It is another object of the present invention to provide a process in which the pre-mixed alcoholic beverage is maintained in a sealed environment.

It is another object of the present invention to provide a process in which the pre-mixed alcoholic beverage has a consistent taste and flavor between separate servings.

It is another object of the present invention to provide a process for preparing a pre-mixed alcoholic beverage that allows for a variety of alcoholic beverages to be dispensed.

It is another object of the present invention to provide a process for preparing a pre-mixed alcoholic beverage which is easy to use and relatively inexpensive.

These and other objects and advantages of the present invention will become apparent from a reading of the attached specification and appended claims.

SUMMARY OF THE INVENTION

The present invention is a process for preparing a pre-mixed alcoholic beverage that comprises the steps of: (1) providing an empty beverage capsule; (2) introducing a dry mix into the empty beverage capsule; (3) adding a liquid alcohol into the dry mix-added beverage capsule so as to substantially fill the beverage capsule; and (4) affixing a lid over the substantially-filled beverage capsule.

In this process of the present invention, the empty beverage capsule is loaded onto a turntable. A supply of empty beverage capsules is provided in a chute adjacent to the turntable. The empty beverage capsule is dropped or discharged from the chute from the supply of empty beverage capsules into a hole in the turntable such that the empty beverage capsule has an open end facing upwardly. The turntable is rotated with the empty beverage capsule in the hole toward a station adjacent the turntable. This station has a supply of dry mix therein. A fixed quantity of the dry mix is discharged from the supply of dry mix into the open end of the empty beverage container. The turntable is rotated to another station having a supply of liquid alcohol. The liquid alcohol is injected or discharged into the open end of the dry mix-added beverage container. The turntable is then rotated further from the alcohol station to a station having a supply of lids. A lid is placed onto the open end of the beverage container. The lid is then heat sealed over the open end of the beverage container. The sealed beverage container can then be removed from the turntable. The sealed beverage container can be ejected automatically from the turntable or removed manually.

In the present invention, the empty beverage container is formed from an aluminum laminated with polyethylene. The polyethylene provides an additional barrier and heat-sealing capability. The liquid alcohol will be approximately 100% alcohol. The dry mix can be selected from the group consisting of margarita mix, sangria mix, mojito mix, strawberry daiquiri mix, piña colada mix, eggnog mix, hurricane mix and bellini mix. The turntable will have a plurality of openings thereon in which each of the plurality of openings is adapted to receive the empty beverage container therein.

The process of the present invention can further include placing the removed sealed beverage container from the turntable and into a coffee maker. Hot water is then passed through the interior of the beverage capsule. The beverage is then discharged from the coffee maker into a container. An ice cube or many ice cubes can be added into the container and to the discharged beverage so as to cool the beverage for consumption. Alternatively, the hot liquid can be poured into a separate container having ice therein.

This foregoing Section is intended to describe, with particularity, the preferred embodiments of the present invention. It is understood that modifications to this preferred embodiment can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
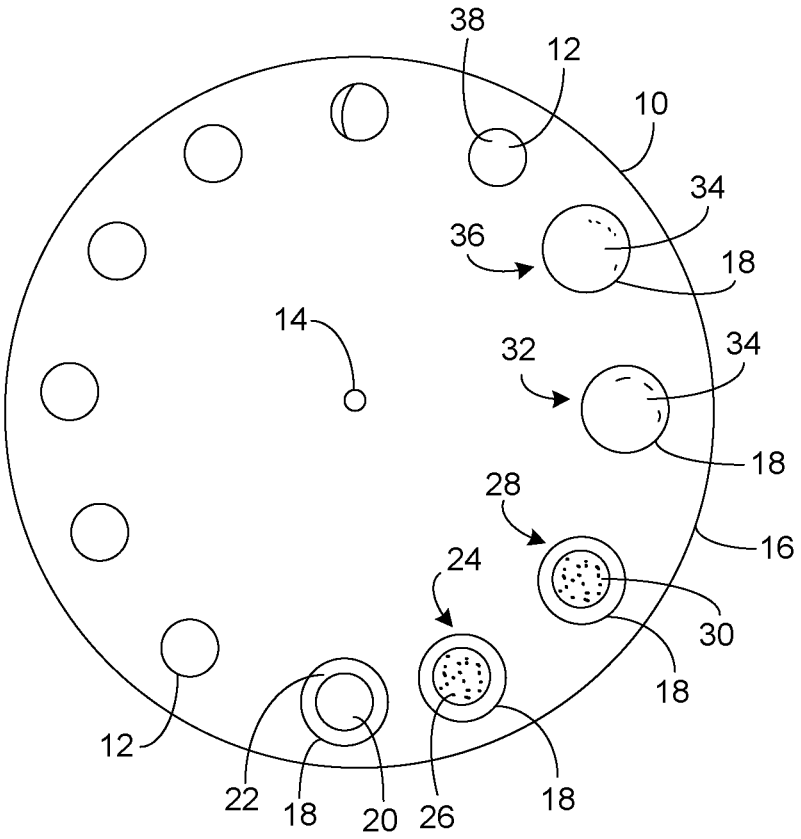
FIG. 1 is a plan view showing the turntable and beverage capsules as used in the process for preparing a pre-mixed alcoholic beverage of the present invention.

Referring to FIG. 1, there is shown a turntable 10 having a plurality of holes 12 formed therein. FIG. 1 shows a total of twelve holes formed through the thickness of the turntable 10. However, within the concept of the present invention, fewer or more holes 12 can be formed. The turntable 10 is rotatable about a central axis 14. The plurality of holes 12 are positioned generally adjacent to the perimeter 16 of the turntable 10.

In FIG. 1, with reference to the process of the present invention, it can be seen that one of the holes 12 has a beverage capsule 18 positioned therein. An open end 20 faces upwardly from the turntable 10. The outer diameter of the beverage capsule 18 is receivable within the interior of the hole 12. A rim 22 of the beverage capsule 18 overlies a portion of the turntable 10 adjacent to the periphery of the hole 12. As such, the beverage container 18 will remain in a fixed position within the hole 12.

FIG. 1 shows another stage in the preparation of the pre-mixed alcoholic beverage of the present invention. As can be seen, the beverage capsule 18 has moved to another station 24. This station 24 places a dry mix 26 into the interior of the beverage container 18. The dry mix 26 will fill a portion of the interior of the beverage capsule 18.

FIG. 1 further shows the beverage capsule 18 as having moved to another station 28. In this station 28, a liquid alcohol 30 is introduced into the interior of the beverage capsule 18. The liquid alcohol 30 will be approximately 100% alcohol and will be measured and enter a remaining portion of the interior of the beverage capsule 18. As such, the beverage capsule 18 will become substantially filled. The amount of alcohol that is measured and enters the remaining portion of the interior of the beverage capsule is measured to be exactly the correct amount. It does not need to fill the entire beverage capsule. The alcohol is absorbed by the dextrin in the dry mix 26. As such, the alcohol percentage in the alcohol that enters the beverage capsule will be between 95% and 100% alcohol.

The beverage capsule 18 is then rotated on the turntable 10 to another station 32. The station 32 supplies a lid 34 over the top of the beverage capsule 18. Lid 34 will have an outer diameter substantially equal to the outer diameter of the rim 22 of the beverage capsule 18. As such, the lid 34 will cover the liquid alcohol 30 and the dry mix 26 within the interior of the beverage capsule 18.

The turntable 10 can then be rotated to a further station 36. Station 36 allows the lid 34 to be sealed onto the rim 22 of the beverage capsule 18. After the lid 34 is sealed on to the rim 22 of the beverage capsule 18, it can then be ejected from the hole 12. As such, hole 38 shows the configuration of the turntable 10 after the beverage capsule 18 has been removed therefrom. Hole 38 is now adapted to continue on with the process by receiving an empty beverage capsule therein. The use of the multiple holes 12 facilitate the ability to provide a continuous process for the manufacture of the pre-mixed alcoholic beverage. The beverage capsule 18 can be removed from the hole 38 by manual removal or automatic ejection.

Figure 2:
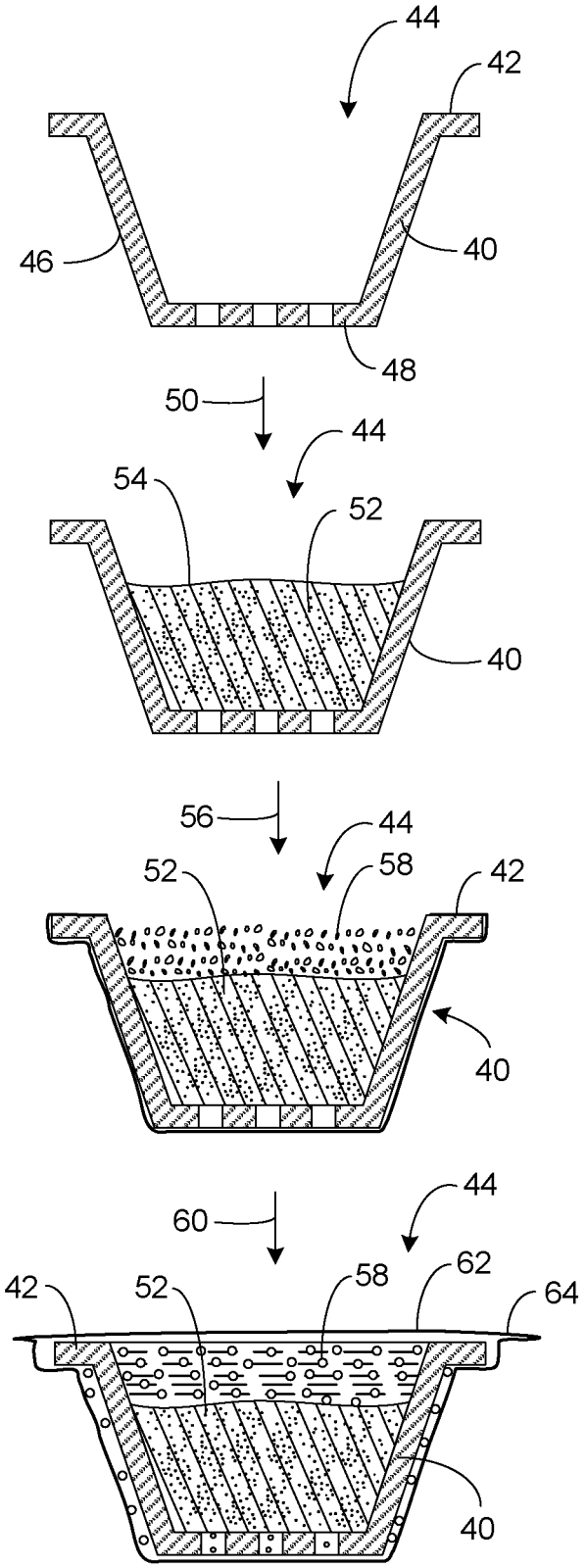
FIG. 2 is a process diagram showing how the beverage capsule is prepared in accordance with the teachings of the present invention.

FIG. 2 shows the specific steps in the process of the present invention. In particular, FIG. 2 shows an empty beverage capsule 40 having a rim 42 and an interior volume 44. The beverage capsule 40 will typically be a K-CUP™ or similar capsule. The walls 46 of the capsule 40 are tapered so as to widen upwardly from the bottom 48. This allows for the easy placement and removal of the capsule 40 into the holes 12 of the turntable 10 and/or from the coffee making machine (to be described hereinafter). FIG. 2 shows that the beverage capsule 40 is empty of any dry mix or liquid alcohol.

FIG. 2 further shows the capsule 40 as having moved in the direction of arrow 50 to the dry mix station of the turntable 10. As can be seen, the dry mix 52 is added into the interior volume 44 of the capsule 40. The dry mix 52 will fill the capsule 40 up to a level 54. It should be noted that level 54 is merely representative of the various levels to which the dry mix 52 can be added. More or less dry mix can be added within the interior volume 44 of the capsule 40. The dry mix 52, in the preferred embodiment of the present invention, can be selected from margarita mix, sangria mix, mojito mix, strawberry daiquiri mix, pina colada mix, eggnog mix, hurricane mix, and/or the bellini mix, or mixtures thereof.

FIG. 2 shows a further step in the process of the present invention in which the beverage capsule 40 moves to another station by way of arrow 56. As such, the beverage capsule 40 will be at the liquid alcohol station. It can be seen that the liquid alcohol 58 is added to the top of the dry mix 52 within the interior volume 44 of the beverage capsule 40. The liquid alcohol 58, in the preferred embodiment the present invention, will be approximately 95% to 100% alcohol. The alcohol 58 will generally be added so it is below the level of the rim 42.

FIG. 2 shows a further step in the closing of the beverage capsule 40 as illustrated by the lid and sealing station indicated by arrow 60. In FIG. 2, the lid 62 has been placed onto the top of the rim 42 of the beverage capsule 40. As such, the liquid alcohol 58 and the dry mix 52 are contained within the interior volume 44 of the beverage capsule 40. The outer periphery 64 of the lid 62 can be heat sealed or welded to the rim 42 of the beverage capsule 40. The lid 62 will be in the nature of a foil aluminized material. In particular, the aluminum polylaminate material of the beverage container will cause the polyethylene material melt during the heat-sealing process in order to bond with the lid.

Figure 3:
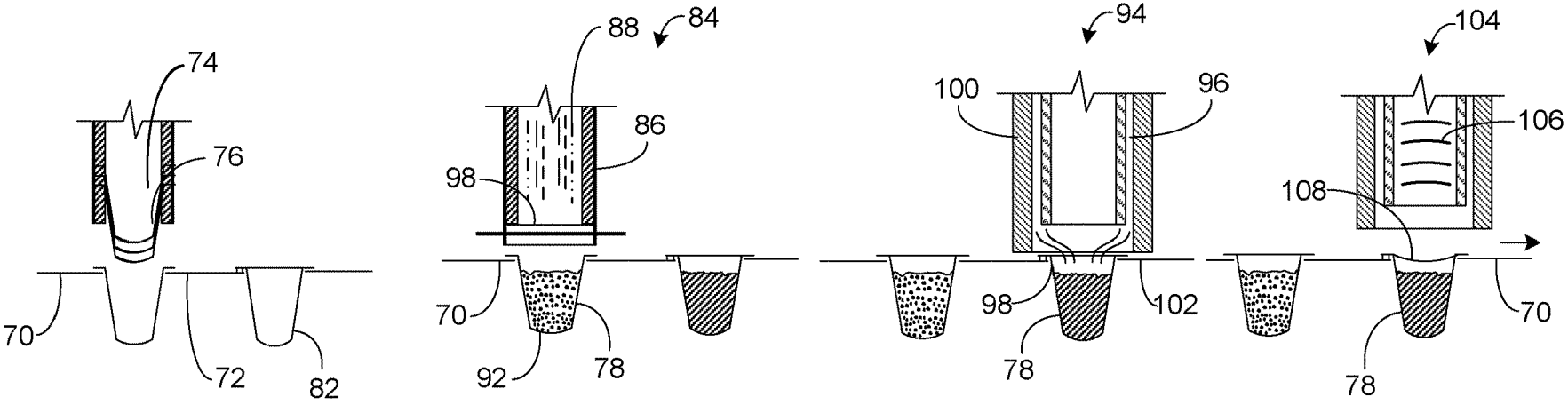
FIG. 3 is a side elevational view showing the steps in the process of the present invention for the preparation of the pre-mixed alcoholic beverage.

FIG. 3 shows further the steps of the present invention. In particular, in FIG. 3, a turntable 70 is illustrated as having a hole 72 formed therein. A chute 74 is located in proximity to the turntable 70 and positioned over the hole 72. A supply of empty beverage capsules 76 is positioned within the interior of the chute 74. One of the plurality of beverage capsules 76 is dropped or discharged such that the beverage container 78 is received within the hole 74 and such that the rim 80 of the beverage container 78 is retained on the turntable 70 (in the manner described hereinbefore). The turntable 70 can be rotated such that the loaded beverage capsule 82 can then move to the next station 84. Station 84 shows a tube 86 having a supply of dry mix 88 on an interior thereof. A suitable closure or valve element is positioned adjacent to the turntable 70 and to the open end of the beverage capsule 78. As can be seen, the dry mix 92 has been added into the interior volume of the beverage capsule 78. The beverage capsules 78 can then be moved along with its dry mix 92 to an adjacent station 94. Station 94 shows the beverage capsule 78 positioned below the alcohol supply 96. It can be seen that the alcohol supply 96 will flow along lines 98 into the interior of the beverage capsule 78. The alcohol squirts from the tube into the dry mix 92 so that there is no leakage.

The liquid alcohol-loaded capsule 78 can then move to a station 104. Station 104 includes a supply of lids 106 therein. One of the lids 108 is placed over the open end of the beverage capsule 78 so as to close the liquid alcohol 98 and the dry mix 92 therein. A sealing element can then be used so as to heat seal the lid to the rim of the beverage capsule or to otherwise affix the lid in a permanent manner to the rim of the beverage capsule. The beverage capsule 78 can then be automatically ejected or manually removed from the turntable 70. An additional station (not shown) can be added which cleans the rim of the beverage container after the dry mix and alcohol have been added. This allows a better bond to be achieved between the polyethylene laminate of the beverage container and the lid during the heat-sealing step.

When the sealed beverage capsule 78 has been removed from the turntable 70, it then can be used for the making of an alcoholic beverage. For example, the capsule 78 can be loaded into the receptacle of a coffee machine (such as a "Keurig" coffee machine). The lid 108 can then be penetrated by the prong of the coffee maker so that hot water can flow through the interior volume of the beverage capsule 78. This will allow a hot alcohol-containing beverage to be dispensed therefrom. The hot beverage is particularly suitable for use as a hot toddy or as a mulled wine. Alternatively, ice cubes can be added to the container so as to cool the alcoholic beverage and make the alcoholic beverage into a cold drink. The beverage capsule 78 can then be removed from the coffee maker and disposed of in a conventional manner. It is important to realize that this combination of the aluminum polylaminate material and lid of the beverage container is more sustainable that the plastic beverage containers of the prior art. The used aluminum polylaminate material can be recycled by melting such that the polyethylene laminate and the residual of the cocktail mix burn off. In order to recycle the beverage container, the lid needs to be removed and the interior of the spent beverage container needs to be cleaned out.

The foregoing disclosure and description of the invention is illustrative and explanatory thereof. Various changes in the details of the illustrated construction can be made is the scope of the present invention without departing from the true spirit of the invention. The present invention should only be limited by the following claims and their legal equivalents.

The invention claimed is:

1. A process for preparing a pre-mixed alcoholic beverage, the process comprising:

providing an empty beverage capsule, step of providing comprising:

loading the empty beverage capsule onto a turntable, the step of loading comprising:

providing a supply of empty beverage capsules in a chute adjacent to the turntable; and dropping one of the empty beverage capsules from the supply of empty beverage capsules in the chute into a hole in the turntable such that the empty beverage capsule has an open end facing upwardly; and rotating the turntable with the empty beverage capsule in the hole toward a station adjacent the turntable, the station having a supply of dry mix therein;

introducing a dry mix into the empty beverage capsule, the step of introducing comprising discharging a fixed quantity of the dry mix from the supply of dry mix into the open end of the empty beverage capsule;

adding a liquid alcohol into the dry mix-added beverage capsule so as to substantially fill the beverage capsule, wherein the step of adding the liquid alcohol comprises:

rotating the turntable from the station having the dry mix to another station, the another station having the supply of the liquid alcohol; and injecting or discharging the liquid alcohol into the open end of the dry mix-added beverage capsule; and affixing a lid over the filled beverage capsule.

2. The process of claim 1, the step of affixing a lid comprising:

rotating the turntable from the another station having the supply of liquid alcohol to a further station, the further station having a supply of lids; and placing one lid of the supply of lids onto the open end of the beverage capsule having the liquid alcohol and dry mix therein.

3. The process of claim 2, further comprising:

sealing the lid over the open end of the beverage capsule.

4. The process of claim 3, further comprising:

removing the sealed beverage capsule from the turntable following the step of sealing the lid.

5. The process of claim 4, wherein the step of removing comprises:

rotating the turntable away from the further station, the sealed beverage capsule being ejected automatically from the turntable.

6. The process of claim 4, wherein the step of removing comprises:

rotating the turntable away from the further station, the sealed beverage capsule being removed manually from the turntable.

7. The process of claim 4, further comprising:

placing the removed sealed beverage capsule from the turntable into a coffee maker;

passing hot water through an interior of the placed beverage capsule; and discharging the hot water-mixed beverage from the coffee maker into a container.

8. The process of claim 7, further comprising:

discharging the hot water mixed beverage into a container having an ice cube therein or adding an ice cube to the discharged hot water-mixed beverage.

9. The process of claim 1, wherein the empty beverage capsule is formed of an aluminum polylaminate.

10. The process of claim 1, wherein the empty beverage capsule has an aluminum lining.

11. The process of claim 1, wherein the dry mix is selected from the group consisting of margarita mix, sangria mix, mojito mix, strawberry daiquiri mixed, piña colada mix, eggnog mix, hurricane mix, and bellini mix and mixtures thereof.

12. The process of claim 1, wherein the turntable has a plurality of openings thereon, each of the plurality of openings adapted to receive the empty beverage capsule therein.

* * * * *